US008701452B2

(12) United States Patent
Foster et al.

(10) Patent No.: US 8,701,452 B2
(45) Date of Patent: Apr. 22, 2014

(54) COMPUTER SECURITY DEVICE

(76) Inventors: Gary D. Foster, Batavia, OH (US); W. Douglas Mayer, West Chester, OH (US)

( * ) Notice: Subject to any disclaimer, the term of this patent is extended or adjusted under 35 U.S.C. 154(b) by 267 days.

(21) Appl. No.: 12/817,987

(22) Filed: Jun. 17, 2010

(65) Prior Publication Data

US 2010/0326144 A1 Dec. 30, 2010

Related U.S. Application Data

(60) Provisional application No. 61/268,966, filed on Jun. 18, 2009.

(51) Int. Cl.
*E05B 73/00* (2006.01)

(52) U.S. Cl.
USPC ..... 70/19; 70/58; 70/218; 70/221; 70/232; 70/DIG. 57; 248/316.1; 248/316.4; 248/553

(58) Field of Classification Search
USPC ..... 70/19, 58, 14, 18, 229–232, DIG. 57, 70/218, 221, 461; 211/4; 248/551–553, 248/316.1, 316.4; 224/315, 322–324; 361/679.57, 679.58; 411/910, 44, 55, 411/60.2, 75, 79, 80
See application file for complete search history.

(56) References Cited

U.S. PATENT DOCUMENTS 1,970,660 A * 8/1934 La Fever ..... 109/52
4,585,202 A * 4/1986 Parsekian ..... 248/553
4,884,420 A * 12/1989 Finkel et al. ..... 70/58
4,942,745 A * 7/1990 Jacobs et al. ..... 70/58
5,330,147 A * 7/1994 Volcheff et al. ..... 248/316.4
5,388,434 A * 2/1995 Kalis ..... 70/58
5,595,074 A * 1/1997 Munro ..... 70/58
RE35,677 E * 12/1997 O'Neill ..... 248/551
6,123,309 A * 9/2000 Sage ..... 248/316.1
7,243,514 B2 * 7/2007 Frantz ..... 70/58
7,520,709 B2 * 4/2009 Wang ..... 411/396
7,647,676 B2 * 1/2010 Carnevali ..... 24/523
7,712,720 B1 * 5/2010 Cheng et al. ..... 248/346.07
7,828,253 B2 * 11/2010 Meyer ..... 248/129
7,866,623 B2 * 1/2011 Lampman et al. ..... 248/551
8,074,951 B2 * 12/2011 Carnevali ..... 248/313
8,091,850 B2 * 1/2012 Carnevali ..... 248/346.04
2011/0024371 A1 * 2/2011 Lampman et al. ..... 211/4
2011/0133050 A1 * 6/2011 Eisenberger et al. ..... 248/551
2012/0037783 A1 * 2/2012 Alexander et al. ..... 248/551

* cited by examiner

*Primary Examiner* — LLoyd Gall
(74) *Attorney, Agent, or Firm* — Wilson D Swayze, Jr.

(57) ABSTRACT

A security device to secure a computer may include a substantially vertical pedestal, a fixed platform mounted on the pedestal, a clamping table to cooperate with the fixed platform to secure the computer and a locking assembly to allow the clamping table to be moved to allow the computer to be attached and released from the fixed platform in an unlocked state and to prevent the clamping table from being moved to hold the computer in a locked state, The locking assembly may include a locking knob to operate the locking assembly between the locked state and the unlocked state, and the locking knob may rotate freely in the locked state and rotates to allow the clamping table to be moved in the unlocked state.

10 Claims, 5 Drawing Sheets

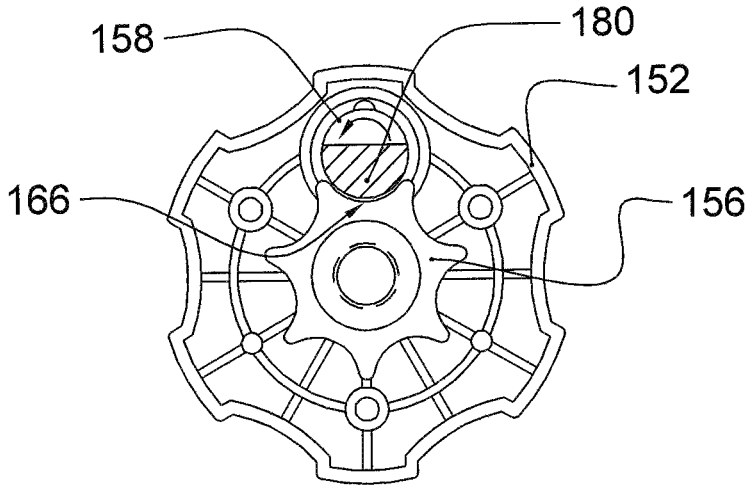
Fig. 10 (Unlocked)
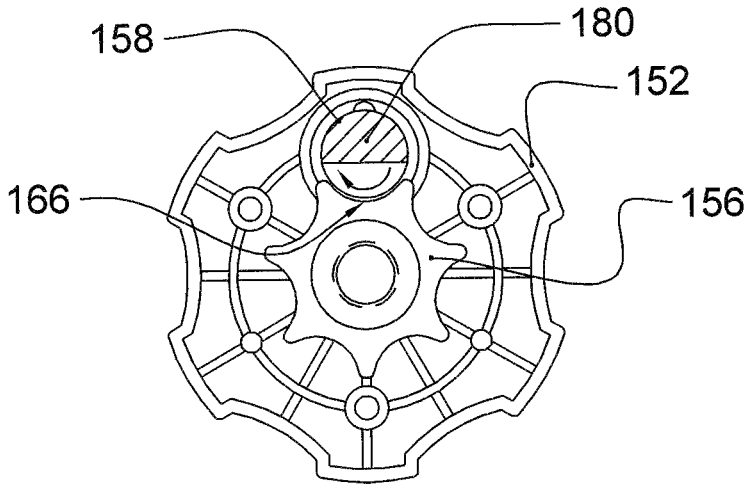
Fig. 11 (Locked)

COMPUTER SECURITY DEVICE

PRIORITY

The present invention claims priority under 35 USC section 119 based upon provisional application Ser. No. 61/268,966 filed on Jun. 18, 2009.

FIELD OF THE INVENTION

The present invention relates to security devices and more particularly to security devices for preventing or deterring theft of electronic devices such as portable computers of the laptop or notebook type.

BACKGROUND OF THE INVENTION

Computers such as laptop and notebook computers, because of their size and portability, are subject to theft. One particular situation in which theft often occurs is in commercial applications where portable computers are left unattended for a brief period of time. These types of computers are widely used by delivery personnel such as operators of freight vans, postal trucks, power, utility companies and their trucks and others, who, in the course of their routes, will find it necessary to leave their vehicles equipped with a computer unattended for a brief period of time in order to deliver or pick up parcels and packages. It is relatively easy for a thief to enter or break into a vehicle during the brief period the driver is away from the vehicle and remove a computer.

Accordingly, many thefts of this type can be avoided by employing a simple, visible security device which requires time and effort to overcome and, accordingly, will deter thieves.

BRIEF SUMMARY

Briefly, the present invention provides a computer security device for portable computers which is securable to a structure and is particularly adaptable for use in mobile application such as in postal, delivery and other mobile vans. The device may be securable to a structure such as a post or pedestal mounted in the vehicle which is secured to the vehicle frame at a location convenient to the vehicle driver. The terms "computer" or "portable computer" as used herein, refer to laptop computers, notebook computers as well as other types of portable electronic device.

The security device of the present invention has a fixed platform having a planar top surface on which the computer is positioned. The planar surface may be cushioned and is provided with apertures or openings for ventilation. The platform is generally rectilinear and one or more adjustable retainers are provided along the sides of the fixed platform. The retainers are both vertically and horizontally adjustable to accommodate various styles and sizes of computers. The retainers are secured in place by proprietary fasteners which require the use of a special driver.

A clamping plate is transversely slidable relative to the fixed platform and also has adjustable retainers. The clamping plate is slidable relative to the fixed platform to accommodate varying sizes of computers. In the locked position, the clamping plate is adjusted so that the retainers on the plate engage the opposite sides of the computer. The clamping plate has a sliding tube that extends into a tubular guide tube on the underside of the fixed platform. The clamping plate is guided by slides extending into appropriate slots on the underside of the fixed platform.

Once the clamping plate has been adjusted and positioned in a clamping position against the computer, the clamping plate is locked in place by a locking assembly having a locking knob. The locking knob has a keylock cylinder which when placed in a locked position allows the locking knob to freely turn on a threaded shaft extending through the sliding tube. Thus, the sliding tube cannot be rotated to an unlocked position. In the locked position, cooperating wedge surfaces on the threaded shaft and sliding tube engage the internal bore in the guide tube preventing movement of the clamping plate. To unlock or release the clamping plate, the keylock is actuated which will cause the knob to become engaged with the threaded rod through a detent permitting the knob to turn the threaded rod to disengage the wedge surfaces unlocking the clamping plate.

BRIEF DESCRIPTION OF THE DRAWINGS

The above and other advantages and objects of the present invention will become more apparent when taken in conjunction with the following description, claims and drawings in which:

FIGS. 10 and 11 are cross-sectional views taken along line 9-9 of FIG. 6 showing the locking knob in a locked position in FIG. 11 and an unlocked position in FIG. 10.

DETAILED DESCRIPTION

Figure 1:
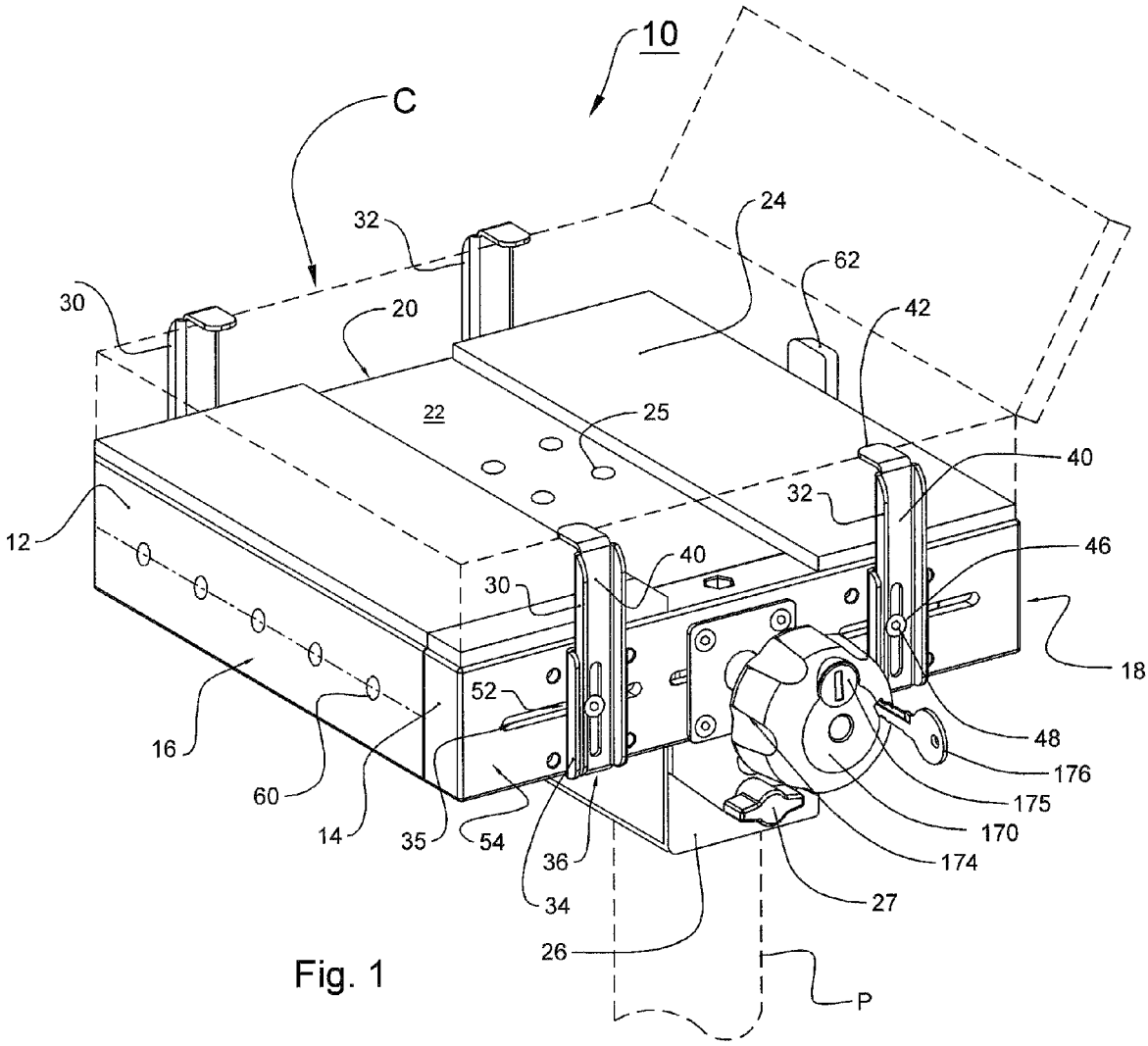
FIG. 1 is a perspective view of the computer security device of the present invention.
Figure 2:
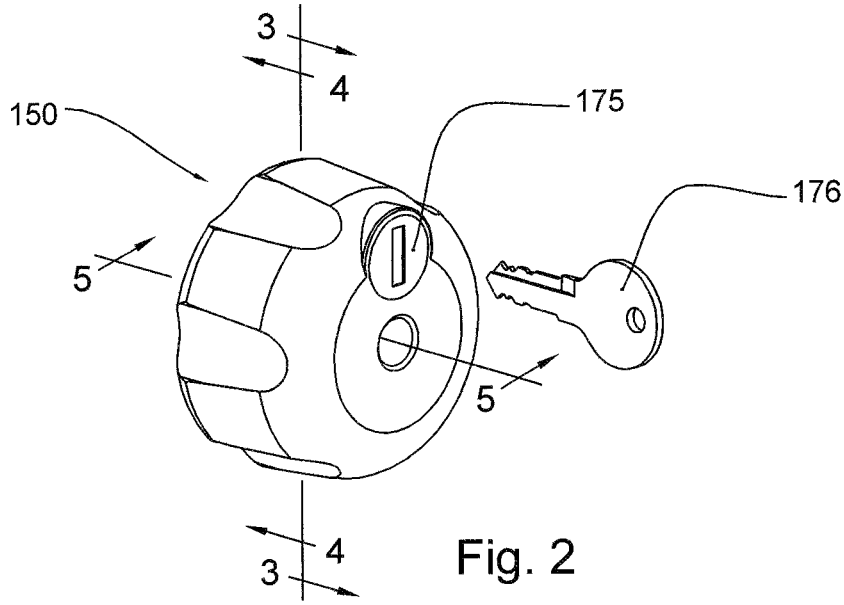
FIG. 2 is a perspective view of the locking knob and key of the present invention.
Figure 3:
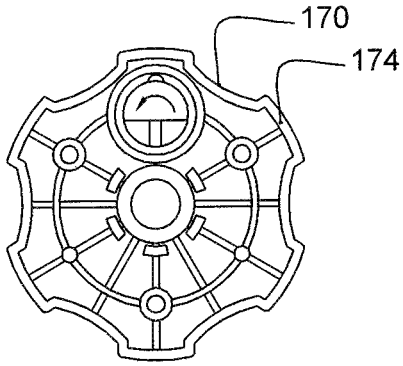
FIG. 3 is a sectional view taken along lines 3-3 of FIG. 2.
Figure 4:
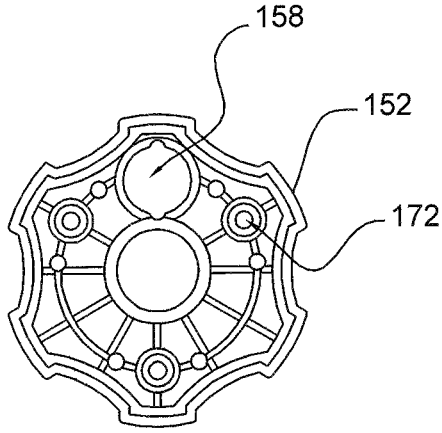
FIG. 4 is a sectional view taken along line 4-4 of FIG. 2.

The present invention provides security features for computers including laptop cradles that is easy to use and does not limit productivity. The present invention easily integrates into an existing system. The present invention provides peace of mind in the knowledge that the computer will not be disturbed even under the most adverse conditions. The use of a key locking knob and slim restraining arms provides easy operation and a high degree of security.

Turning now to the drawings, a preferred embodiment of the security device of the present invention is generally denoted by the reference number 10. The device 10 has a fixed platform 12 and an adjustable clamping table or plate 14. The fixed platform 12 is preferably rectangular having opposite front and rear walls 16 and 18, sidewall 20 and a generally planar top surface 22. The top surface 22 may be provided with strips of resilient cushioning material 24 extending along the opposite sides 16 and 18. One or more apertures or vent holes 25 may be provided for airflow. A bracket 26 which cooperates with the underside of the platform is secured to a structure such as a pedestal P secured to the vehicle. The bracket 26 is angularly adjustable by the knob 27.

The fixed platform 12 may be fabricated from any suitable material and is preferably fabricated using a lightweight metal or is molded from a suitable, sturdy plastic such as ABS or similar sturdy, rigid thermoplastic. Sidewalls 20 and 54 of the clamping plate each carry a pair of spaced-apart retainer assemblies 30 and 32, which are similarly constructed. As best seen in FIG. 1, each of the retainers 30 and 32 has a generally U-shaped base channel 34 which has a projection or flange 36 extending beneath the edge of its respective sidewall. The retainers 30, 32, are horizontally adjustable with respect to a slot 35 in the associated wall. A clamping member 40, also having a generally U-shape, is vertically slidable relative to the base channel 34. The clamping member has an inwardly extending projection 42 which will engage a surface of the computer. A computer C is represented in dotted lines and may be any of various types and models of smaller, portable computer such as notebook and laptop computers. The retainers 30, 32 are vertically and horizontally adjusted to accommodate various computers. The retainers 30, 32 each are secured by a fastener 46 having a proprietary head 48 which requires a special driver tool to be loosened to deter tampering.

Adjustability is achieved by loosening the single fastener 46 associated with each clamping member. When the fastener 46 with a proprietary head is loosened, the vertically sliding clamping member 40 can be adjusted relative to the fastener 46 and to the base channel 34. Similarly, the entire assembly including the clamping member 40 and the base channel 34 can be moved horizontally in the associated slot 35 in the sidewall 54. When the desired position is reached with the projection 42 on the end of the clamping member 40 engaging a surface of the computer, the proprietary fastener can be secured. The proprietary fastener 46 has a threaded body which engages a generally oval nut (not shown) on the opposite surface of the sidewalls 54. The oval nut has a projection which extends into the slots 35 so that the nut cannot be rotated to loosen the retainers 30, 32.

The opposite front and rear walls 16, 18 are each provided with bores 60 in which stop members 62 may be secured using a fastener, preferably having a proprietary head. The stops 62 associated with the front and rear walls 16, 18 of the fixed table extend above the surface of the table and will engage the front and rear of the portable computer to prevent it from being slid from beneath the retainers 30 and 32.

In the normal use position, the cover of the portable computer is open and the computer is positioned as shown in dotted lines in FIG. 1. The clamps or retainers 30, 32 associated with the opposite sidewalls of the device will engage the opposite sides of the computer. The stops 62 associated with the front and rear walls of the platform will engage or about the front and rear surfaces of the computer so that the computer is fully engaged and retained so that it cannot be quickly removed without effort or the use of special tools. As mentioned above, the effort and time and special tools that may be involved in order to remove the computer from the security device of the present invention will provide substantial deterrent to theft since in most instances a would-be thief has only several minutes of opportunity in which to remove the computer.

Figure 8:
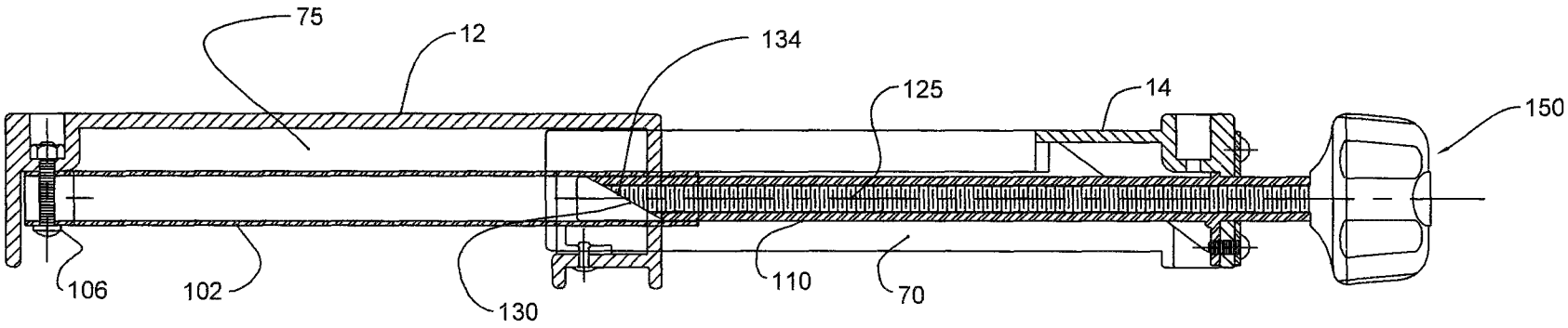
FIG. 8 is a cross sectional view of showing the device in an open position.
Figure 9:
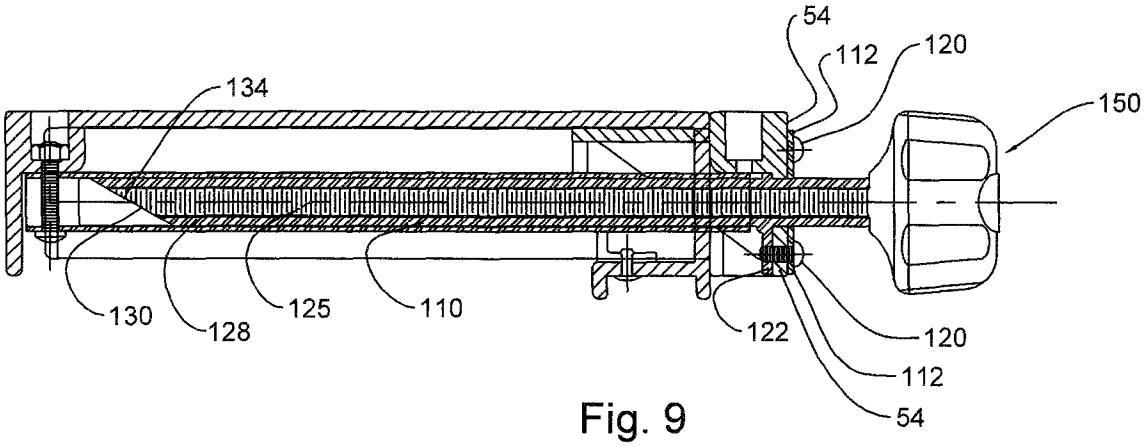
FIG. 9 is a cross-sectional view showing the fixed mounting plate and the clamping plate in a closed position.

As seen in FIG. 8, the clamping plate 14 has a pair or oppositely disposed slide members 70. The slide members 70 are received in channels 75 extending along the underside of the fixed platform 12. In the closed position, the slidable clamping table abuts the fixed platform as best seen in FIGS. 1 and 9. The sliding clamping plate allows for transverse adjustment to accommodate various widths or portable computers.

Adjustment for accommodating computers having various lengths is generally not required as the platform is sized to accommodate most computers and electronic devices of this type and further the stops 62 on the front and rear walls will prevent the computer from being slidably removed from the security device. Normally the portable computer is positioned on the security device with the cover open, as seen in FIG. 1. The cover may be closed, but the inwardly extending projections on the retainers 30, 32 on the sidewalls will be positioned between the cover and the body of the computer to prevent the computer from being moved forwardly. Adjustability is achieved by positioning the clamping plate 14 to bring the retainers 30, 32 into engagement with the opposite side of the computer. The clamping plate 14 is transversely slidable relative to the fixed platform and sliding movement is accommodated by the slide member 70 on the opposite side of the clamping table which extend into channels beneath the platform. When the clamping table or section is in the desired position, it can be locked by a locking mechanism to retain further movement.

Figure 7:
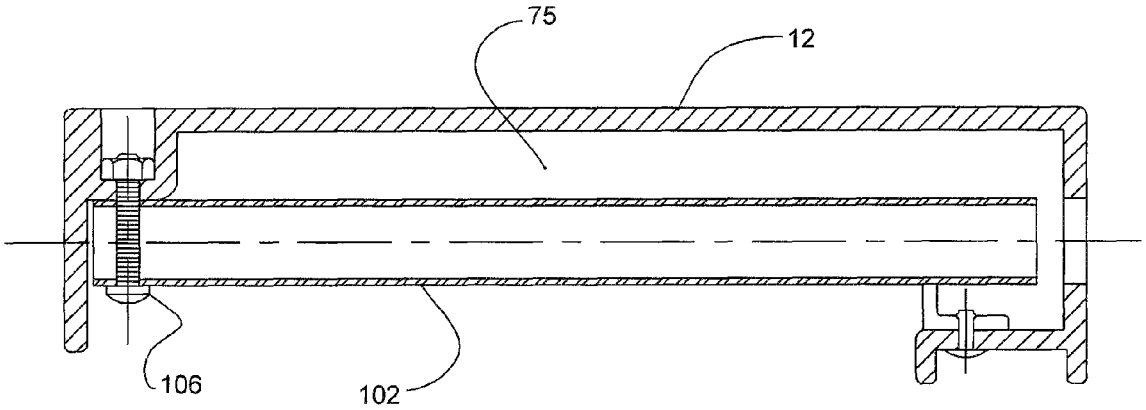
FIG. 7 is a longitudinal cross-sectional view of the fixed platform.

As best seen in FIGS. 7, 8, and 9, the locking mechanism 100 includes an outer guide tube 102 which extends transversely and is connected to the underside of the platform 12. The outer tube may be an integrally molded component of the platform or may be secured at the outer end of the tube and by a suitable fastener 106. The guide tube 102 is stationary and receives an inner slidable tube 110. The slidable tube 110 extends outwardly from the sidewall 54 on the clamping plate 14. A bracket plate 112 is welded or otherwise secured to the sliding tube 110 inward of its end and the tube assembly of components 110, 112 are secured to the sidewall 54 of the clamping section by proprietary fasteners 120 which extends through the sidewall 54 of the clamping plate and through threaded bores in plate 122.

Within the inner sliding tube is an elongate threaded rod 125 which is slidable connected relative to the inner tube 110. The inner end 128 of the sliding tube 110 has an angled wedge surface 130. The inner end of the threaded rod has a complementary angular wedge surface 134.

Figure 5:
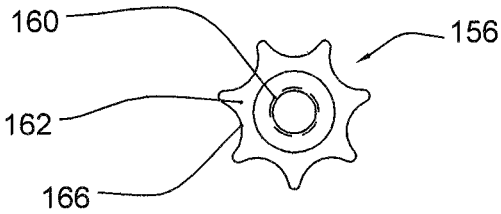
FIGS. 5 and 5A are detail views of the star locking wheel component of the lock assembly.
Figure 5A:
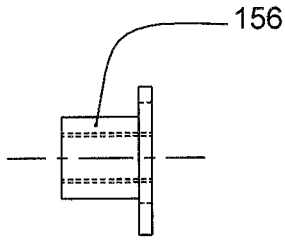
Figure 6:
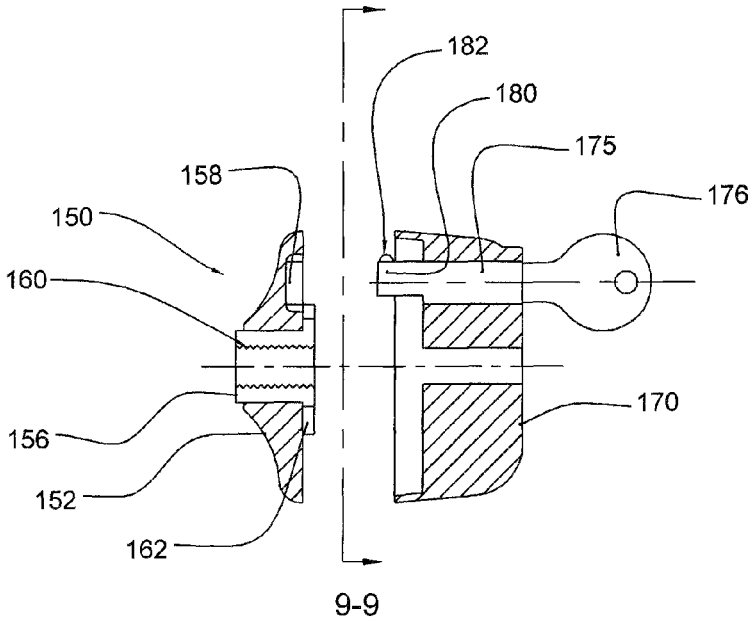
FIG. 6 is a cross-sectional view of the locking knob.

The outer end of the threaded rod carries a locking knob assembly 150. The locking knob assembly is best shown in FIGS. 2 to 6 and 9 and 10 includes an inner hub 152 having a central bore which receives an insert 156. The inner surface of the hub also defines a circular bore 158 which will receive a section of a cylinder lock 175 as will be explained. The insert 156 has a centrally threaded section 160 which is in threaded engagement with the end of the threaded shaft 125. The insert carries a flange 162 which has a star wheel periphery defined by a plurality of arcuate sections 166, as best seen in FIGS. 5, 9, and 10. It will be noted that when one of the arcuate section 166 is aligned with the bore 158, the arcuate sections and bore are positioned so that the bore is fully accessible, as seen in FIGS. 9 and 10.

The knob 170 of the locking assembly is secured to the hub by a plurality of fasteners at 172 extending from the rear of the hub. The knob has an exterior surface with a series of ribs 174 to facilitate manual rotation of the knob assembly. A bore extends through the knob and receives a cylinder lock 175. The cylinder lock is rotatable by means of a key 176. The inner end of the cylinder lock has a projection 180 which is semi-circular and configured to be received within the bore 158 in the hub. A spring-loaded detent ball 182 projects from the curved outer surface of the detent projection.

In the unlocked position, as shown in FIG. 9, the cylinder lock detent projection 180 extends into the bore 158 of the hub and the arcuate section 166 of insert 156 engage the projection 180 on the cylinder lock. In this position, rotation of the knob 170 will rotate the insert 156 relative to the threaded knob 170. As the knob 170 is rotated in a direction to tighten the knob, a locking action will be initiated by the wedge surfaces 130, 134 causing the end 128 to tightly engage the inner surface of tube 102. This will secure the table in the position in which it has been placed to properly secure a computer.

If the key is inserted into the cylinder lock and the cylinder rotated placing the semi-circular projection 180 in the position shown in FIG. 11, in which the detent projection 180 is positioned, disengaged from one of the arcuate sections 166 on the insert 156, the knob will rotate freely about the threaded shaft preventing unlocking of the clamping table. Thus, the lock assembly is unique in that in the locking knob 170 is disengaged from the threaded rod and can rotate freely when locked and only when the locking assembly is in the unlocked position can the knob 170 be rotated to allow the clamping table to be moved relative to the fixed table, the cylinder is rotated by means of a key to a position so that the cylinder barrel projection is in engagement with one of the arcuate sections in the periphery of the insert 156 which will permit the knob to rotate the insert 156 several turns of rotation to unlock the locking tube mechanism.

It will be obvious to those skilled in the art to make various changes, alterations and modifications to the invention described herein. To the extent such changes, alterations and modifications do not depart from the spirit and scope of the appended claims, they are intended to the encompassed therein.

The invention claimed is:

1. A security device, comprising:

a computer to be secured;

a substantially vertical pedestal;

a fixed platform mounted on the pedestal;

a clamping table to cooperate with the fixed platform to secure the computer;

a locking assembly to allow the clamping table to be moved to allow the computer to be attached and released from the fixed platform in an unlocked state and to prevent the clamping table from being moved to hold the computer in a locked state;

wherein the locking assembly includes a locking knob to operate the locking assembly between the locked state and the unlocked state, and wherein the locking knob rotates freely in the locked state and rotates to allow the clamping table to be moved in the unlocked state:

wherein the locking assembly includes an outer guide tube and wherein the locking assembly includes an inner guide tube to cooperate with the outer guide tube.

2. A security device to secure a computer as in claim 1, wherein the security device includes a bracket to anglely adjust the fixed platform.

3. A security device to secure a computer as in claim 1, wherein the fixed platform includes a clamping member.

4. A security device to secure a computer as in claim 1, wherein the clamping table includes a clamping member.

5. A security device to secure a computer as in claim 3, wherein the clamping member is vertically slidable.

6. A security device to secure a computer as in claim 4, wherein the clamping member is vertically slidable.

7. A security device to secure a computer as in claim 1, wherein the locking assembly includes a threaded rod which cooperates with the inner guide tube.

8. A security device to secure a computer as in claim 7, wherein the inner guide tube includes an angled wedge surface.

9. A security device to secure a computer as in claim 8, wherein the threaded rod includes an angular wedge surface to cooperate with the angled wedge surface of the inner guide tube.

10. A security device to secure a computer as in claim 1, wherein the locking knob includes a cylindrical lock to move the locking assembly between the locked state and the unlocked state.

* * * * *